US009739080B2

(12) United States Patent
Yoon et al.

(10) Patent No.: US 9,739,080 B2
(45) Date of Patent: Aug. 22, 2017

(54) DEVICE FOR OPENING AND CLOSING SLIDING DOOR

(71) Applicant: GCI GLOBAL CO., LTD., Incheon (KR)

(72) Inventors: Tae Yang Yoon, Bucheon-si (KR); Yu Jin Bae, Incheon (KR)

(73) Assignee: GCI GLOBAL CO., LTD., Incheon (KR)

( * ) Notice: Subject to any disclaimer, the term of this patent is extended or adjusted under 35 U.S.C. 154(b) by 168 days.

(21) Appl. No.: 14/647,032

(22) PCT Filed: Mar. 28, 2013

(86) PCT No.: PCT/KR2013/002581
§ 371 (c)(1),
(2) Date: May 22, 2015

(87) PCT Pub. No.: WO2014/081088
PCT Pub. Date: May 30, 2014

(65) Prior Publication Data

US 2015/0300068 A1 Oct. 22, 2015

(30) Foreign Application Priority Data

Nov. 23, 2012 (KR) ..... 10-2012-0133451

(51) Int. Cl.
*E05D 15/00* (2006.01)
*E05D 15/06* (2006.01)
(Continued)

(52) U.S. Cl.
CPC ..... *E05D 15/0621* (2013.01); *E05D 15/0608* (2013.01); *E05D 15/10* (2013.01);
(Continued)

(58) Field of Classification Search
CPC ..... E05D 15/0621; E05D 15/0604; E05D 15/0608; E05D 15/10; E05D 15/1042;
(Continued)

(56) References Cited

U.S. PATENT DOCUMENTS 3,064,723 A * 11/1962 Paillard ..... E05D 15/1065 160/113
3,990,183 A * 11/1976 Meggs ..... A47K 3/362 49/125
(Continued)

FOREIGN PATENT DOCUMENTS

JP 61186619 A * 8/1986
JP 07276989 A * 10/1995
(Continued)

*Primary Examiner* — Chuck Mah
(74) *Attorney, Agent, or Firm* — Novick, Kim & Lee, PLLC; Jae Youn Kim

(57) ABSTRACT

Provided is a device for opening and closing a sliding door, of which collinearly placed doors slide respectively to overlap each other such that the sliding door is opened or closed. The device includes a sliding portion formed on a surface on which doors come into contact with each other in order to prevent the doors from interfering with each other when the doors are opened; a pair of rail frames formed on a top surface of the furniture and provided with a rail protruding upwardly such that each door is slid forward and backward on the rail, the rail having both sides in which bending portions are formed; and rotational members, each of which is installed to one side of a connection bracket to be rotatable in a curved section of the bending portion while being lifted and slid on the rail.

8 Claims, 8 Drawing Sheets

(51) Int. Cl.

| | |
|---|---|
| ***E06B 3/46*** | (2006.01) |
| ***E05F 3/18*** | (2006.01) |
| ***E05F 5/00*** | (2017.01) |
| ***E05D 15/10*** | (2006.01) |
| *E05F 3/06* | (2006.01) |
| *E05F 1/16* | (2006.01) |

(52) U.S. Cl.
CPC ..... *E05D 15/1042* (2013.01); *E05F 3/18* (2013.01); *E05F 5/003* (2013.01); *E06B 3/4672* (2013.01); *E05D 2015/1055* (2013.01); *E05F 1/16* (2013.01); *E05F 3/06* (2013.01); *E05Y 2201/212* (2013.01); *E05Y 2201/412* (2013.01); *E05Y 2201/684* (2013.01); *E05Y 2600/314* (2013.01); *E05Y 2900/20* (2013.01)

(58) Field of Classification Search
CPC ..... E05D 15/0634; E05D 15/0639; E05D 15/0652; E05D 15/0656; E05D 2015/1005; E05F 1/16; E05F 3/06; E05F 3/18; E05F 5/003; E05Y 2201/212; E05Y 2201/412; E05Y 2201/684; E05Y 2600/314; E05Y 2900/20; E06B 3/4762
See application file for complete search history.

(56) References Cited

U.S. PATENT DOCUMENTS

| | | | | | |
|---|---|---|---|---|---|
| 4,281,435 | A * | 8/1981 | Winter | E05D 15/0621 | 16/94 R |
| 4,478,006 | A * | 10/1984 | Johnson, Jr. | E05D 15/0626 | 16/105 |
| 4,565,031 | A * | 1/1986 | Sakamoto | E05D 15/1042 | 49/127 |
| 4,573,286 | A * | 3/1986 | Favrel | E05D 15/0626 | 16/104 |
| 4,704,819 | A * | 11/1987 | Tutikawa | E05D 15/1042 | 16/102 |
| 4,708,410 | A * | 11/1987 | Mazaki | E05D 15/1065 | 312/138.1 |
| 4,800,945 | A * | 1/1989 | Arteaga | E05D 15/12 | 104/109 |
| 5,070,575 | A * | 12/1991 | Redman | E05D 15/0634 | 16/105 |
| 5,718,083 | A * | 2/1998 | Dowdell, II | E05F 5/003 | 312/334.46 |
| 5,931,554 | A * | 8/1999 | Koopman | E05D 3/022 | 16/286 |
| 6,115,968 | A * | 9/2000 | Sarlanis | E05D 15/0634 | 16/105 |
| 6,463,625 | B2 * | 10/2002 | Mittag | E05D 15/0639 | 16/105 |
| 6,497,072 | B2 * | 12/2002 | Fries | E05B 65/08 | 49/146 |
| 7,962,999 | B2 * | 6/2011 | Yeh | 16/89 | |
| 8,096,629 | B2 * | 1/2012 | Halfon | E05D 15/0652 | 312/319.7 |
| 8,375,645 | B2 * | 2/2013 | Iwauchi | E05D 15/1042 | 49/127 |
| 8,984,810 | B2 * | 3/2015 | Bortoluzzi | E05D 15/1042 | 312/139 |
| 2004/0098831 | A1 * | 5/2004 | Elmer | E05D 15/0652 | 16/89 |
| 2010/0199563 | A1 * | 8/2010 | Bortoluzzi | E05D 15/1042 | 49/128 |
| 2014/0250633 | A1 * | 9/2014 | Allen | E05D 15/0652 | 16/96 R |

FOREIGN PATENT DOCUMENTS

| | | | | |
|---|---|---|---|---|
| JP | 2002371766 | A | * | 12/2002 |
| JP | 2003193739 | A | * | 7/2003 |
| JP | 2007332577 | A | * | 12/2007 |
| JP | 2008-031805 | A | | 2/2008 |
| JP | 2009-127199 | A | | 6/2009 |
| JP | 2010255273 | A | | 11/2010 |
| KR | 10-0762984 | B1 | | 10/2007 |
| KR | 10-2009-0096242 | A | | 9/2009 |
| KR | 10-0942221 | B1 | | 2/2010 |
| KR | 10-0987123 | B1 | | 10/2010 |
| KR | 10-2011-0049085 | A | | 5/2011 |
| KR | 10-1087289 | B1 | | 11/2011 |
| KR | 10-2012-0046383 | A | | 5/2012 |
| KR | 10-2012-0058020 | A | | 6/2012 |
| KR | 10-1180469 | B1 | | 9/2012 |

* cited by examiner

DEVICE FOR OPENING AND CLOSING SLIDING DOOR

TECHNICAL FIELD

The present invention relates to a device for opening and closing a sliding door, and more particularly, to a device for opening and closing a sliding door, which is smoothly opened in the simplest structure without any complex structures by the rotation of a rotational member which slides while collinearly placed doors are sliding to overlap each other when opened or closed.

BACKGROUND ART

Generally, a door is installed at the front of furniture such as a wardrobe, a table, a storage closet or a bathroom cabinet to give fine appearance while the stored articles are prevented from being damaged without exposing the stored articles, and such a door is substantially classified as a swing type door or a sliding type door according to the opening scheme.

In case of the swing type door, one side of the door is hinge-coupled or provided with a hinge installed thereto, so that the door is opened and closed with a constant radius of rotation around the fixing point and corresponding to a width of the door. Thus, there must be secured a constant rotation radius necessary to open or close the door necessary to open or close the door.

In case of the sliding type door, doors overlap each other to be opened or the overlapped doors are spread on rails provided as many as the number of doors while the doors slide relatively to each other. Although the sliding type door is not required to secure a space corresponding to the rotation radius for rotating the doors differently from the swing type door described above, since the rails are exposed in state that the door is closed, the appearance is deteriorated. In addition, when foreign materials such as dust are heaped on the rails, the doors may not be smoothly operated.

In addition, in case of the sliding type door, due to the rails provided as many as the number of doors, the storage space of furniture may be reduced due to the width of the rails To solve the above-described problems, a sliding type door has been disclosed in Korean Registered Patent No. 10-0987123 previously applied by and issued to the same applicant as the present invention, in which one door desired to be opened overlaps another door to be opened toward a front of the another door while the desired door is spaced apart forward from the another door by separation means provided to sliding means when the desired door slides on a rail installed to a top surface by the sliding means.

However, in the above-described registered patent, the door has a complex structure due to the sliding means and the separation means provided to the sliding means.

To solve the problems, a device for opening and closing a door, which is invented to improve the above-described patent, has been disclosed in Korean Registered Patent No. 10-1180469 issued to the same applicant as the present invention, in which the doors slide on a pair of rail frames having rail grooves, which are installed to the top and bottom surfaces of furniture while the doors overlap each other by an upper connection frame, a lower installation frame and forward and backward transporting means, so that the doors are opened or closed.

In addition, as disclosed in Korean Registered Patent No. 10-1087289, a sliding member is provided on a connection frame to move forward and backward while a door slides on a pair of rail frames having rail grooves, which are installed to the top and bottom surfaces of furniture, so that the door is opened or closed.

However, the door disclosed in the registered patents essentially includes the forward and backward transporting means or the sliding member which moves forward and backward while the door slides, and the forward and backward transporting means or the sliding member has also a very complex structure, so that the assembly work is cumbersome and inconvenient.

DOCUMENT OF RELATED ART

[Patent document 1] Korean Registered Patent No. 10-0987123

[Patent document 2] Korean Registered Patent No. 10-1180469

[Patent document 3] Korean Registered Patent No. 10-1087289

DISCLOSURE

Technical Problem

To solve the problems described above, an object of the present invention, which is improved based on the registered patterns previously applied by and issued to the same applicant as the present invention, is to provide a device of opening and closing a sliding door, which is smoothly opened in the simplest structure without any complex structures by the rotation of a rotational member which slides while collinearly placed doors are sliding to overlap each other when opened or closed.

It is another object of the present invention to provide a device of opening and closing a sliding door which is capable of conveniently adjusting heights of each door.

It is still another object of the present invention to provide a device of opening and closing a sliding door, which includes a pair of rail frames provided to a top surface of furniture and having the simplest structure.

It is still another object of the present invention to provide a device of opening and closing a sliding door, which is capable of smoothly sliding on a low portion of the door or a bottom surface of furniture to be stably opened or closed.

It is still another object of the present invention to provide a device of opening and closing a sliding door, which is capable of minimizing a forward or backward movement of the door.

It is still another object of the present invention to provide a device of opening and closing a sliding door, which is capable of minimizing a left or right movement of the door.

It is still another object of the present invention to provide a device of opening and closing a sliding door, which is capable of closing smoothly and stably the door without any damages when the door is closed after being opened.

It is still another object of the present invention to provide a device of opening and closing a sliding door, which is provided on the bottom surface of furniture to slide in the simplest guiding structure.

Technical Solution

To solve the above-described above, according to one aspect of the present invention, there is provided a device for opening or closing a sliding door which is slidably opened or closed at a front of furniture formed therein with a containing space. The device includes: a sliding portion formed on a surface at which doors come into contact with each other in order to prevent the doors from interfering with each other when the doors are opened; a pair of rail frames formed on a top surface of the furniture and provided with a rail, which protrudes upwardly and is formed at both sides thereof with bending portions, such that each door is slid forward and backward on the rail; and rotational members, each of which has one side placed on the rail at an opposite side of a connection bracket coupled to an upper end of the door such that the rotational members are rotatable in a curved section of the bending portion while sliding on the rail.

The sliding portion includes inclined surfaces or interference preventing spaces formed in each door and facing each other in a side direction of the furniture.

The rotational member includes a roller put on the rail to roll; and a coupling bracket, on which the roller is mounted to roll, rotatably coupled to the connection bracket.

The coupling bracket is provided with a boss inserted into an inserting hole form in the connection bracket, and a height of the connection bracket is adjusted on the coupling bracket by an adjusting bolt screw-coupled to the boss.

The pair of rail frames is divided into a linear rail frame in which front and rear rails are integrally formed in a liner section; and curved rail frames provided at both sides of the linear rail frame, each of the curved rail frames having front and rear rails formed in the curved sections of the bending portion.

The device further includes a pair of support frames formed on a lower surface of the furniture, each of the support frames having a guide support groove formed at both sides thereof with curved portions to allow each door to slidably move forward and backward; and support members each having one side inserted into the guide support groove at an opposite side of a support bracket coupled to a low end of the door such that the support member is slid.

The support member includes a support roller having an inserting protrusion which is inserted into the guide support groove to roll; and a rotational bracket, on which the support roller is mounted to roll, rotatably coupled to the support bracket.

The rotational bracket is provided with an inserting boss inserted into a coupling hole formed in the support bracket, and a height of the support bracket is adjusted on the rotational bracket by an adjusting bolt screw-coupled to the inserting boss.

The device further includes buffer members provided to each curved portion of both sides of the support frame, wherein each of the buffer members provides buffer power when the door is opened while the rotational bracket is latched to or released from the buffer member.

The buffer member includes a guide groove corresponding to the curved portion; a moving member formed with an inserting groove, the moving member allowing the rotational bracket to be inserted into or released from the inserting groove while moving in the guide groove; a movable support having one end rotatably coupled to the moving member and an opposite end coupled to a restoring spring such that the movable support is rotatably fixed; and a damper having buffer power when making contact with one surface of the movable support.

The device further includes a support rail formed on a rear upper surface of the furniture to which the rail frame is fixed such that the door is prevented from moving to left or right when the door is slidably opened or closed; a support coupled and fixed to the connection bracket in an opening direction of the door; and a moving prevention roller installed on the support to roll in the support groove of the support rail.

The device further includes a pair of guide frames provided on a lower surface of the furniture, each of the guide frames having a guide groove which is provide at both sides thereof with guide curved portions to allow each door to be slid forward and backward; and a guide roller having one side inserted into the guide groove, such that the guide roller slides at an opposite side of the mounting bracket mounted on a low end of the door.

The guide roller is rotatably mounted on the mounting bracket, such that the guide roller rolls vertically or horizontally in the guide groove.

Advantageous Effects

According to the present invention, the device for opening and closing a sliding door is smoothly opened in the simplest structure without any complex structures by the rotation of a rotational member which slides while collinearly placed doors are sliding to overlap each other when opened or closed, so that the door may be smoothly opened and closed without any additional forward and backward transporting means. In addition, the device may have an excellent assembly property due to the simplest components and the manufacturing cost may be remarkably reduced.

In addition, the heights of each door may be easily adjusted, so that the fine height adjustment of the door may be conveniently adjusted, and the reliability may be improved as well as the appearance.

In addition, the pair of rail frames is provided to a top surface of furniture and has the simplest structure, so that the number of components may be reduced. Thus, the device can be readily assembled, so that the economic efficiency can be more improved.

In addition, the device can smoothly slide on a low portion of the door or a bottom surface of furniture to be stably opened or closed, so that the door may be stably opened or closed without any forward or backward movements, thereby improving the reliability of the door.

In addition, the forward and backward or left and right movements of the door may be minimized, so that the reliability of the door may be more improved.

In addition, when the opened door is closed, the door may be closed stably and smoothly while impact noise is minimized by the buffer force, so that the furniture may be prevented from being damaged due to the damage, thereby giving high reliability to the product.

In addition, the sliding guide structure provided a bottom surface of the furniture may be configured at the simplest, so that the assembly property may be increased and the manufacturing cost may be more reduced.

BEST MODE

Mode for Invention

Hereinafter, embodiments of the present invention will be described in more detail with reference to accompanying drawings. The present invention is not limited to the following embodiments but includes various applications and modifications.

Figure 1:
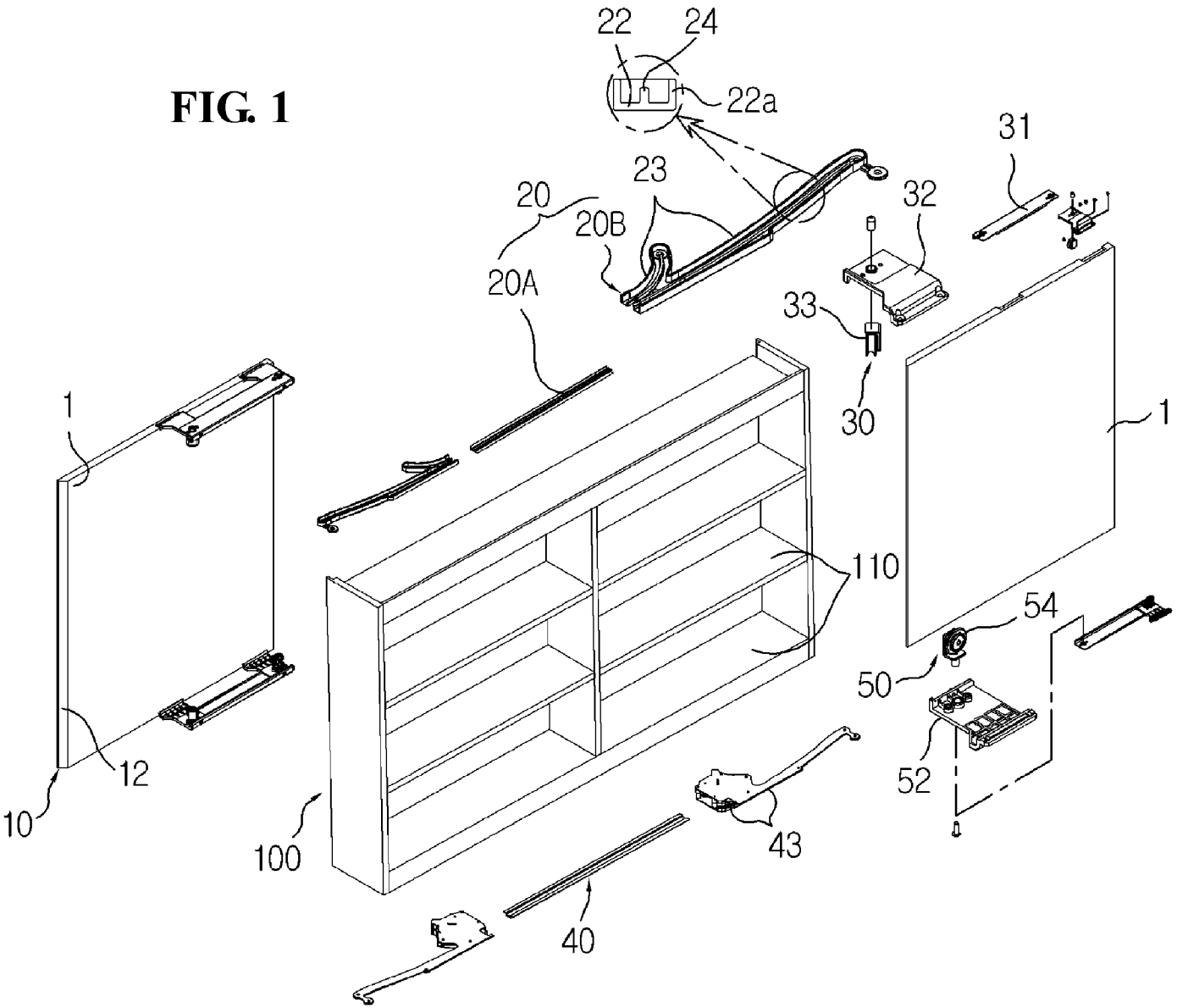
FIG. 1 is an exploded perspective view schematically illustrating the present invention.
Figure 2:
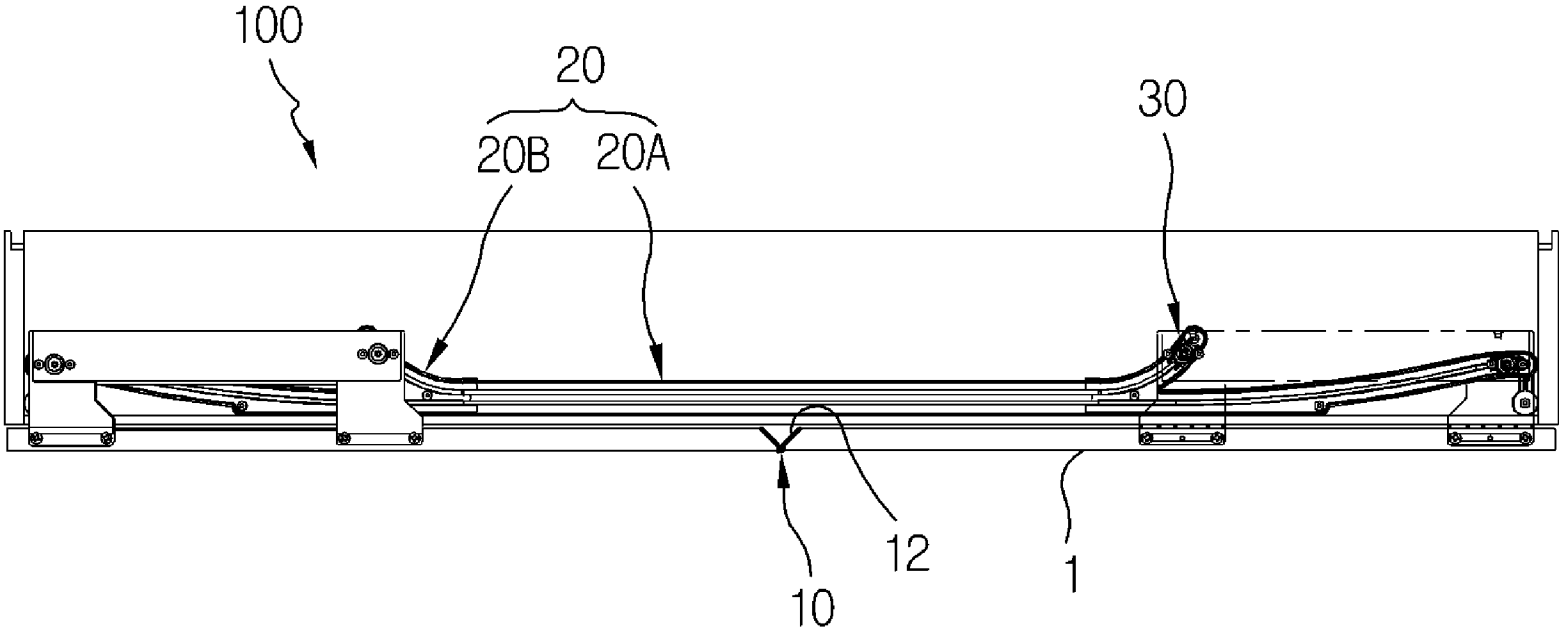
FIG. 2 is a schematic plan view showing a main part of FIG. 1.
Figure 3:
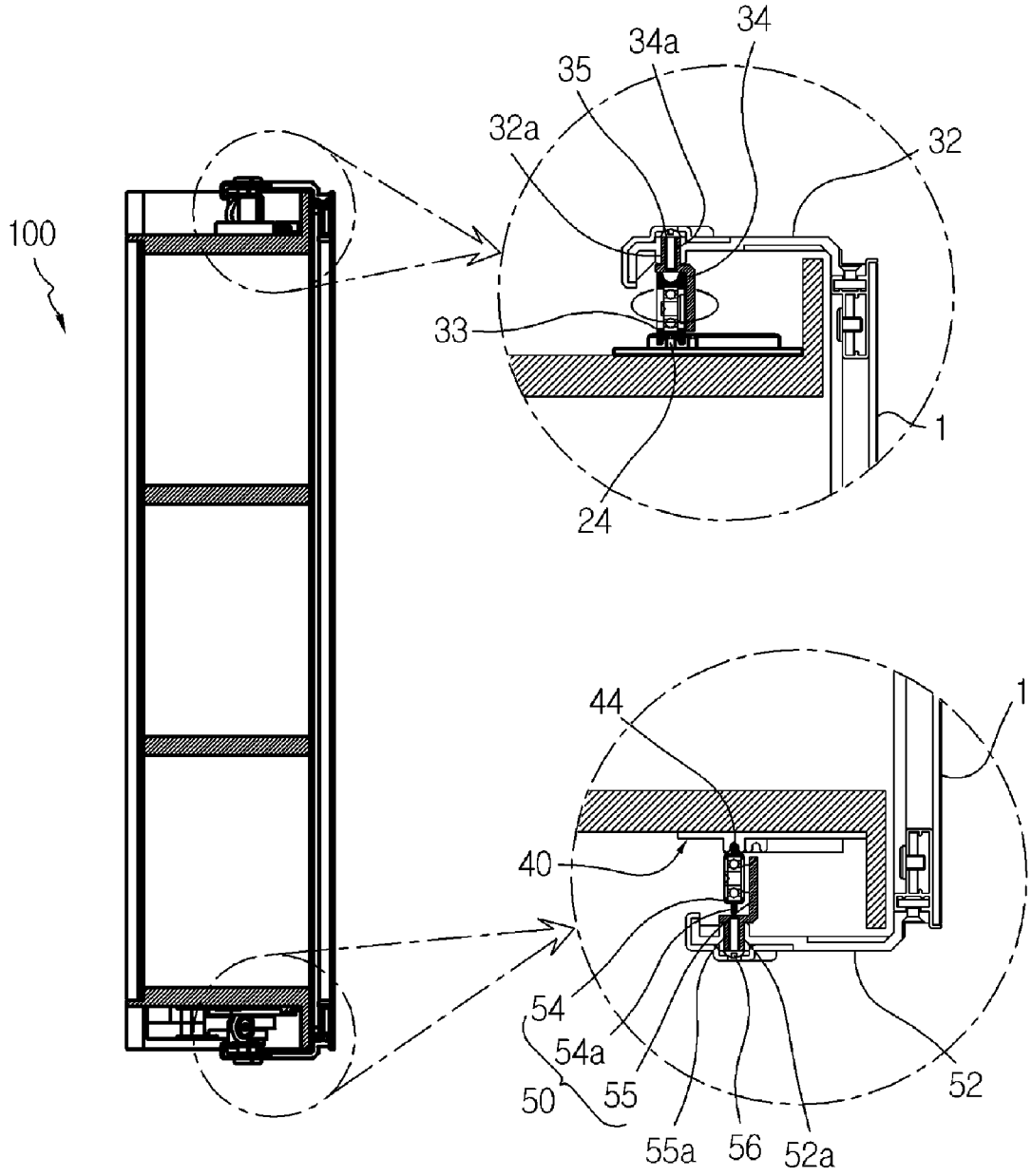
FIG. 3 is a schematic side sectional view illustrating a main part of FIG. 1.
Figure 4:
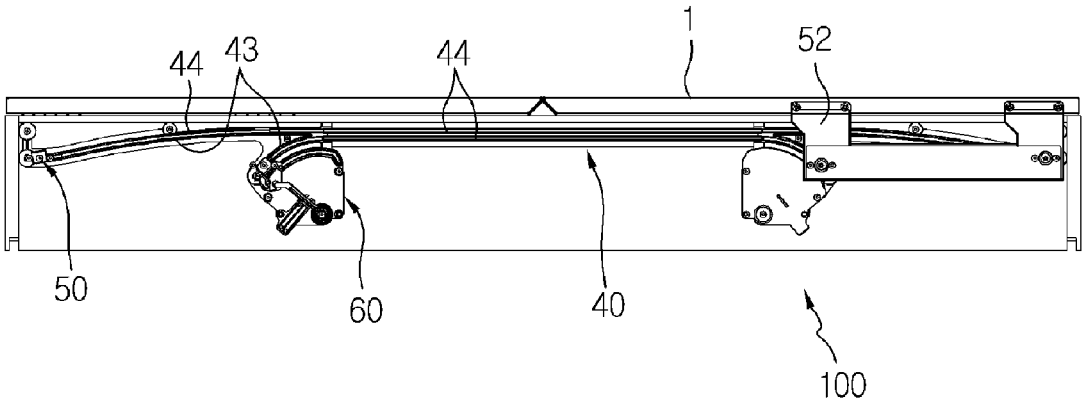
FIG. 4 is a schematic bottom view showing a main part of FIG. 1.

FIG. 1 is an exploded perspective view schematically illustrating a main part of the present invention. FIG. 2 is a schematic plan view of FIG. 1. FIG. 3 is a schematic side sectional view illustrating a main part of FIG. 1. FIG. 4 is a schematic bottom view showing a main part of FIG. 1.

As shown in the drawings, there is provided a sliding door 1 which is slidably opened or closed at a front of furniture formed therein with a containing space 110 for keeping articles therein while the keeping articles are prevented from being damaged without exposing the keeping articles. In addition, the sliding door 1 may have fine appearance and maximize the containing space.

In order to smoothly open the sliding door in the simplest structure without any complex structures by the rotation of a rotational member which slides while collinearly placed doors are sliding to overlap each other when opened or closed, the present invention includes:

a sliding portion 10 formed on a surface on which the doors 1 come into contact with each other in order to allow a door to smoothly slide without interfering between the doors, wherein the sliding portion 10 is provided to prevent one door from interfering with another door to be opened, such that the another door may smoothly slide on the one door without interference with the surface of the one door facing the another door;

a pair of rail frames 20 provided with a rail which protrudes upwardly and has bending portions 23 formed at both sides, such that the doors 1 move forward and backward, wherein the doors 1 are opened while overlapping each other or closed when each door 1 slides on a top surface of a fixing flange 22 which is in a form such as a conventional train rail and is coupled and fixed to a top surface of furniture 100, such that the doors are collinearly placed; and rotational members 30, each of which has one side placed on the rail at an opposite side of a connection bracket 32 coupled to an upper end of the door such that the rotational members 30 are rotatable in a curved section of the bending portion 23 while sliding on the rail 24, where each rotational member 30 is rotated by itself to be transported forward and backward without any additional means moving forward and backward.

Figure 5:
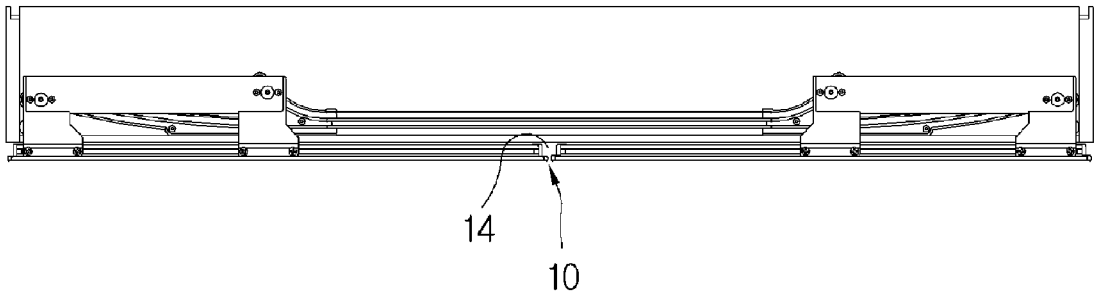
FIG. 5 is a schematic view showing a main part of another embodiment of the present invention.

Preferably, the sliding portion 10 includes inclined surfaces 12 or interference preventing space (See FIG. 5) 14 formed in each door 1 and facing each other in a side direction of the furniture 100. That is, in state that the doors become in contact with each other, when a door to be opened is transported forward while the rotational member slides in the curved section of the bending portion, the door may be smoothly transported forward without interfering with the contact surface of the closed door.

As described above, if necessary, an edge chin 22*a* such as a rail 24 may be formed on the fixing flange 22 of the rail frame 20.

Thus, without any additional forward and backward transporting means together with the rotational member, the doors sliding by the sliding portion and the rotational member are opened to overlap each other or closed, so that the doors may be collinearly placed.

The rotational member 30 includes a roller 33 put on the rail 24 to roll, and a coupling bracket 34, on which the roller 33 is mounted to roll, rotatably coupled to the connection bracket 32. In this case, the coupling bracket 34 provided with a boss 34*a* inserted into an inserting hole 32*a* formed in the connection bracket 32, and a height of the connection bracket 32 is preferably adjusted on the coupling bracket 34 by an adjusting bolt 35 screw-coupled to the boss 34*a*.

In other words, as the adjusting bolt 35 screw-coupled to the boss 34*a* is rotated, the connection bracket 32 moves up on the boss 34*a* of the coupling bracket 34, so that the height of the door 1 connected to the connection bracket 32 may be adjusted. In this case, the height of the door may be adjusted not in a large range but in a fine range after being installed.

Reference numeral 31, which is not described above, is a fixing plate for fixing the connection bracket.

According to the present invention described above, while the sliding doors 1 overlap each other to be opened and closed while sliding at the front of furniture, the doors are smoothly transported forward and backward to overlap and be opened or closed by the sliding portions 10 formed on the surfaces of the doors 1 making contact with each other and the rotational member 30 provided to the connection bracket 32 mounted on the top end of the door 1 without requiring any additional forward and backward transporting means.

That is, since the rotational member 30 is provided to be rotated by itself in the curved section of the bending portion 23 formed in the rail 24, the rotational member 30 is smoothly rotated in the curved section of the bending portion 23 to slide, so that the doors 1 may be transported forward and backward without any forward and backward transporting means.

In addition, since the height of the rotational member 30 is finely adjusted after the doors 1 are installed, the pair of doors 1 placed at the front of the furniture 100 may have a condition to be exactly installed without being crooked.

Therefore, differently from the related art, the present invention does not have a complex structure such as forward and backward transporting means for transporting a door, but has the simplest structure due to the rotational member which is rotated by itself on the rail of the rail frame and allows the doors to smoothly slide such that the doors are opened and closed while overlapping each other.

In addition, due to the simple structure, the device can be readily assembled so that the productivity can be improved and the economic efficiency can be more improved.

Further, the pair of front and rear rail frames 20 is preferably divided into a linear rail frame 20A in which front and rear rails 24 are integrally formed in the linear section, and curved rail frames 20B provided at both sides of the linear rail frame 20A, each of the curved rail frames 20A having the front and rear rails 24 formed in the curved sections of the bending portion 23.

In other words, the front and rear rail frames of the rail frame are not separately manufactured, but are formed in a form of three modules by dividing the front and rear rails for the rail frame, which are linearly placed on the single flange, into the linear section and the curved section of the bending portion, so that the number of components may be more reduced. Thus, the device may have more excellent economic efficiency.

Meanwhile, in order to prevent the door from moving forward or backward and at the same time, to allow the door to smoothly slide on a lower surface of furniture, the device preferably includes: a pair of support frames 40 formed on the lower surface of the furniture, each of the support frames 40 having a guide support groove 44 formed at both sides of the guide support groove 44 with curved portions 43 to allow each door to slidably move forward and backward; and support members 50 each having one side inserted into the guide support groove 44 at an opposite side of a support bracket 52 coupled to a low end of the door 1 such that the support member 50 is slid. In this case, similarly to the rail frame formed on the top surface of the furniture described above, the support frame is divided into a linear support fame and a curved support frame, and the linear and curved support frames are also connected and fixed to each other through the fixing support described above.

Preferably, the support member 50 includes a support roller 54 having an inserting protrusion 54*a* which is inserted into the guide support groove 44, such that the support roller 54 rolls to prevent the door from moving forward and backward; and a rotational bracket 55, on which the support roller 54 is mounted to roll, rotatably coupled to the support bracket 52.

In addition, preferably, the rotational bracket 55 is provided with an inserting boss 55*a* inserted into a coupling hole 52*a* formed in the support bracket 55, and a height of the support bracket 52 is adjusted on the rotational bracket 55 by an adjusting bolt 56 screw-coupled to the inserting boss 55*a*.

In other words, similarly to the rail frame and the rotational member formed on the top surface of the furniture described above, the support frame and the support member are formed on the bottom surface of the furniture while the door is slidably opened or closed, so that the door stably slides without moving forward and backward.

In addition, similarly to the coupling and connection brackets of the rotational member connected to the top end of the door to adjust the height of the door, as described above, the heights of the support frame and the support member may be adjusted on the support bracket of the support member or the rotation bracket, so that the door may be more exactly installed without being crooked.

Thus, the door may stably slide by the support frame and the support member together with the bottom or top end of the door without moving forward and backward, so that the product reliability may be more improved.

Figure 6:
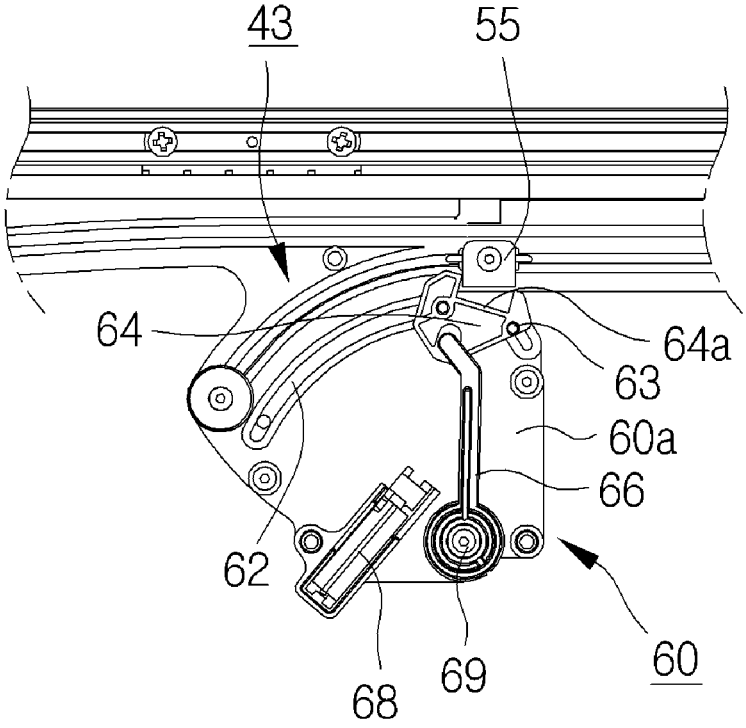
FIGS. 6 and 7 are schematic views showing a main part of still another embodiment of the present invention.
Figure 7:
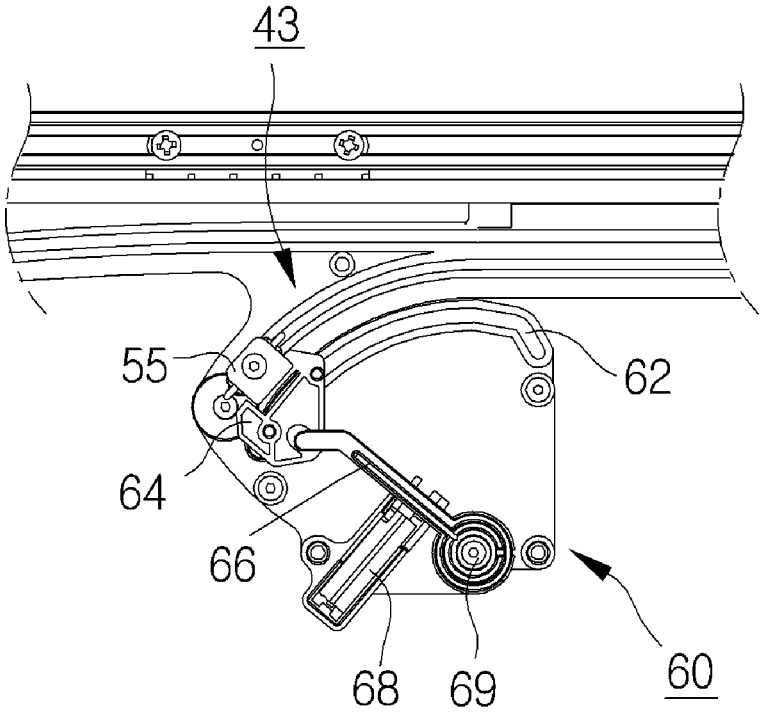

As shown in FIGS. 6 and 7, in order to allow the door to be stably opened or closed while minimizing the impact noise generated when the door is closed after being opened, preferably, buffer members 60 are provided to each curved portion of both sides of the support frame 40, that is, at the position approximate to the curved portion of one shorter than the other of the curved portions, and provide buffer power when the door is opened while the rotational bracket 55 is latched to or released from the buffer member 60.

The buffer member 60 includes a guide groove 62 corresponding to the curved portion 43 in the housing 60*a* vertically constructed; a moving member 64 formed with an inserting groove 64*a*, where the moving member 64 allows the rotational bracket 55 to be inserted into or released from the inserting groove 64*a* while being moved in the guide groove 62 by a moving roller 63 formed downwardly, a movable support 66 having one end rotatably coupled to the moving member 64 and an opposite end coupled and rotatably fixed to a restoring spring 69 such as a conventional torsion spring, and a damper 68 having buffer power when making contact with one surface of the movable support 66, where the damper 68 may be a conventional buffer member. In this case, as shown in the drawings, the housing is preferably formed integrally with the support frame to reduce the number of components. However, it is no harmless to manufacture and install the housing separately from the support frame.

As described above, one end of the restoring spring is fixed to the movable support and the opposite end is fixed to a shaft rotatably coupled to the movable support.

When the support member is positioned at the curved portion while the door is closed, as shown in FIG. 6, in state that the moving member, in which the inserting groove is formed and which is rotatably provided to the movable support, is inclined to allow the rotational bracket serving as the support member to be smoothly inserted into the inserting groove, the movable support makes contact with the damper coupled to the moving member as shown in FIG. 7 while the moving member slides along the guide groove if the rotational bracket is introduced into the inserting groove to be slid, so that the buffer member has buffer force. Thus, the impact generated when the door is closed is buffered, so that the impact noise may be prevented from being generated and the furniture may be prevented from being damaged due to the impact.

In addition, as shown in FIG. 7, in state that the door is closed and buffered, when the door is opened, the movable support smoothly moves to an original position of FIG. 6 by the restoring spring while the movable support slides together with the door.

In addition, it is no harmless to form the buffer member integrally with or separately from the rail frame formed on the top surface of the furniture as well as the support frame formed on a low portion of the furniture, such that the coupling bracket of the support member is latched to or released from the buffer member, thereby giving the buffer force to the buffer member.

Figure 8:
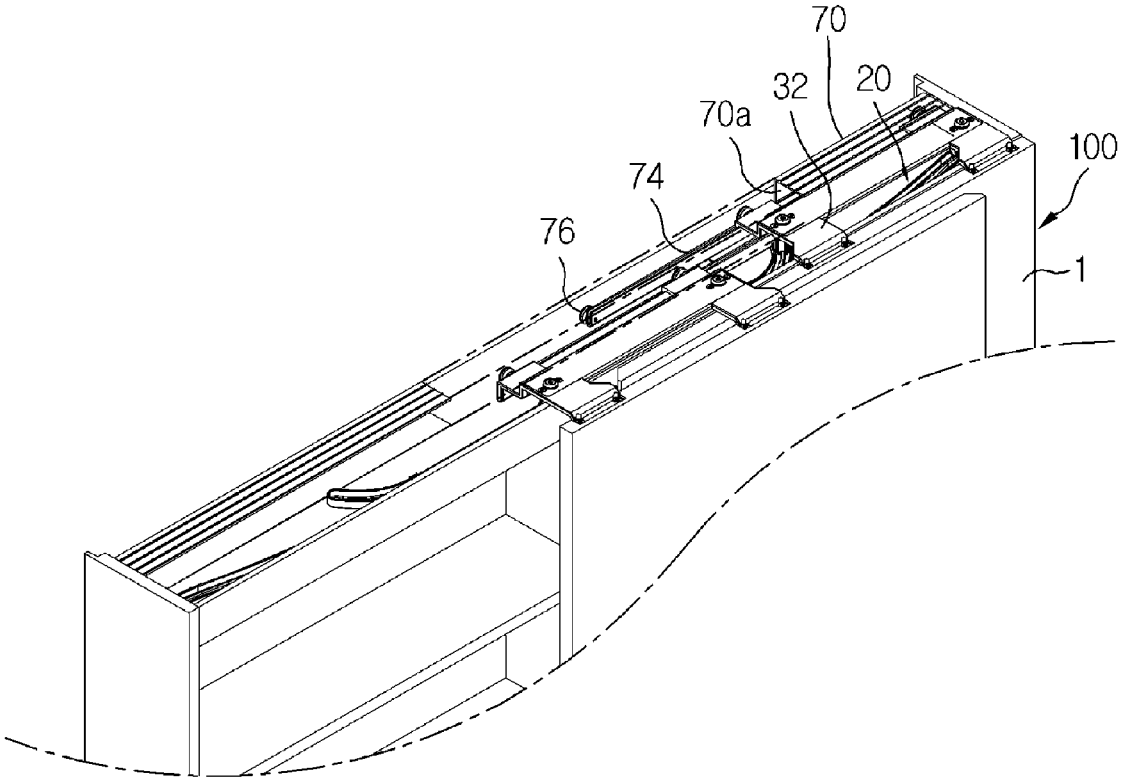
FIG. 8 is a schematic view showing a main part of still another embodiment of the present invention.

FIG. 8 is a schematic view showing a main part of till another embodiment of the present invention.

As shown in FIG. 8, in order to minimize the left and right movement of the door in a transverse direction to the door sliding direction while the door slides to be opened in a longitudinal direction to the transverse direction, the device includes:

a support rail 70 formed on a rear upper surface of the furniture 100 to which the rail frame 20 is fixed such that the door 1 is prevented from moving left or right in the transverse direction when the door 1 is slidably opened or closed in the longitudinal direction, where the support rail 70 has a square C-shape; a support 74 coupled and fixed to the connection bracket 32 in an opening direction of the door through a conventional scheme; and a moving prevention roller 76 installed on the support 74 to roll in the support groove 70*a* of the support rail 70. In this case, the support 74 is installed and fixed to a portion extending from the connection bracket 32.

Thus, when the door is opened or closed while the door is slid by the rotation member of the connection bracket provided to the rail frame, the door may be stably slid by the support and the moving prevention roller supported on the support rail without moving left and right in the transverse direction.

Figure 9:
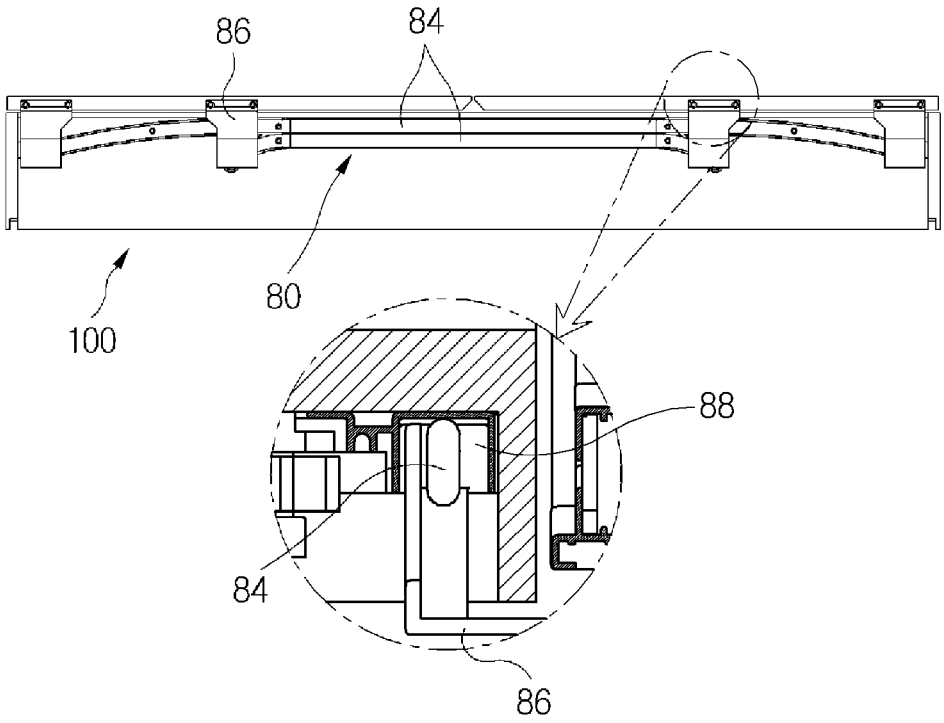
FIG. 9 is a schematic view showing a main part of still another embodiment of the present invention.

FIG. 9 is a schematic view showing a main part of still another embodiment of the present invention.

As shown in FIG. 9, to simplify the structure provided to the lower surface of the furniture to prevent the door from moving forward and backward, the device includes:

a pair of guide frames 80 provided on the bottom surface of the furniture 100, where each of the guide frames 80 has a guide groove 84 which is provide with guide curved portions 82 formed at both sides to allow each door 1 to be slid forward and backward, and has an inverted U-shape; and a guide roller 88 having one side inserted into the guide groove 84, such that the guide roller 88 slides toward an opposite side of the mounting bracket 86 mounted on a low end of the door 1. In this case, it is possible to divide the guide frame into linear and curved sections.

Preferably, the guide roller 88 is rotatably mounted on the mounting bracket 86 such that the guide roller 88 vertically rolls in the guide groove.

Figure 10:
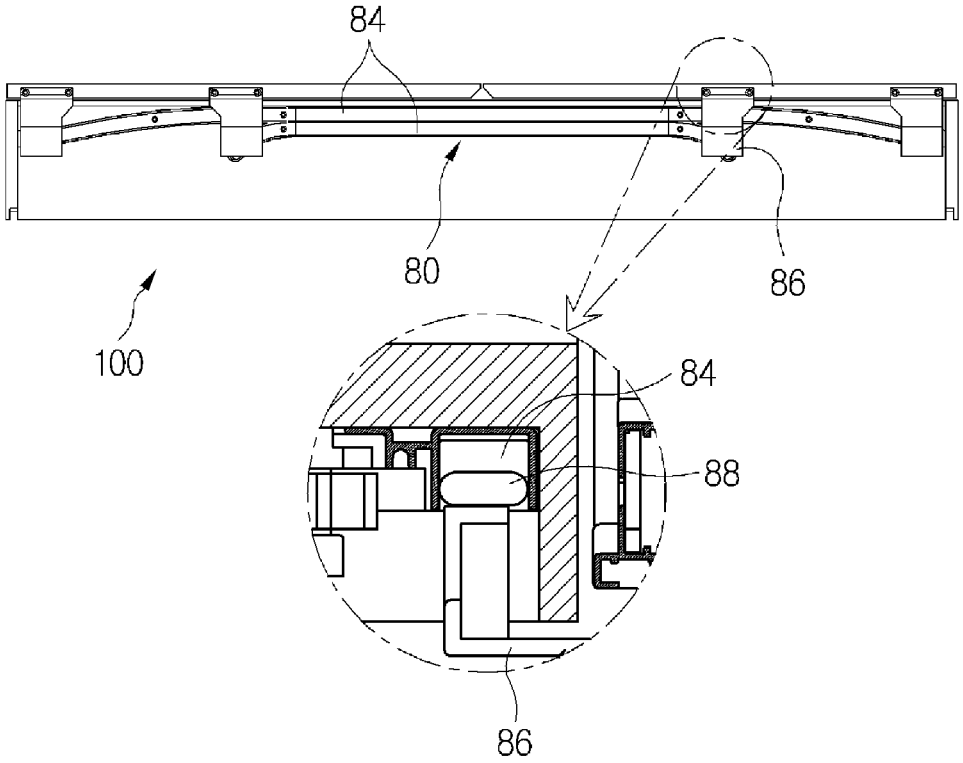
FIG. 10 is a schematic view showing a main part of still another embodiment of FIG. 9.

In addition, as shown in FIG. 10, the guide roller 88 provided in the guide groove 84 slides while horizontally supporting the side surface of the guide groove 84, so that the guide groove 84 is located higher than the guide roller 88, of which the forward and backward movement is vertically formed.

The device is formed perpendicularly and in parallel to the guide groove of the guide frame so that the door is prevented from moving forward and backward. Thus, the device minimizes forward and backward movement of the door is minimized while having the simplest structure, so that the device may be readily assembled and the manufacturing cost may be reduced.

INDUSTRIAL APPLICABILITY

The present invention is applicable to all furniture, such as a wardrobe, a table, a storage closet or a bathroom cabinet, to which a sliding door is applied.

The invention claimed is:

1. A device for opening or closing a sliding door which is slidably opened or closed at a front of furniture formed therein with a containing space, the device comprising:

a rail frame disposed on a top surface of the furniture, the rail frame including a linear portion and a curved portion; and a rotational member configured to be placed on the rail frame and connected to a connection bracket coupled to an upper end of the sliding door, wherein the rotational member includes a roller put on the rail frame to roll; and a coupling bracket, on which the roller is mounted to roll, rotatably coupled to the connection bracket, and wherein the coupling bracket includes a boss inserted into an inserting hole located in the connection bracket, and a height of the connection bracket is configured to be adjusted on the coupling bracket by an adjusting bolt screw-coupled to the boss.

2. The device of claim 1, wherein the sliding door includes inclined surfaces or interference preventing spaces formed in a side surface thereof.

3. A device for opening or closing a sliding door which is slidably opened or closed at a front of furniture formed therein with a containing space, the device comprising:

a rail frame disposed on a top surface of the furniture, the rail frame including a linear portion and an upper curved portion;

a rotational member configured to be placed on the rail frame and connected to a connection bracket coupled to an upper end of the sliding door;

a support rail disposed on a portion of the top surface of the furniture to which the rail frame is fixed such that the sliding door is prevented from moving to left or right in a transverse direction to a sliding direction of the door when the door is slidably opened or closed, the support rail including a support groove;

a support coupled and fixed to the connection bracket in an opening direction of the door; and a moving prevention roller installed on the support to roll in the support groove of the support rail.

4. The device of claim 3, further comprising:

a support frame disposed on a lower surface of the furniture, the support frame having a guide support groove and a lower curved portion; and a support member inserted into the guide support groove at an opposite side of a support bracket coupled to a low end of the door such that the support member is slid.

5. The device of claim 4, wherein the support member includes a support roller having an inserting protrusion which is inserted into the guide support groove to roll; and a rotational bracket, on which the support roller is mounted to roll, rotatably coupled to the support bracket.

6. The device of claim 5, wherein the rotational bracket is provided with an inserting boss inserted into a coupling hole formed in the support bracket, and a height of the support bracket is configured to be adjusted on the rotational bracket by an adjusting bolt screw-coupled to the inserting boss.

7. The device of claim 5, further comprising a buffer member connected to the upper or lower curved portion, wherein the buffer member provides buffer power when the door is opened while the rotational bracket is latched to or released from the buffer member.

8. The device of claim 7, wherein the buffer member includes a guide groove corresponding to the upper or lower curved portion;

a moving member formed with an inserting groove, the moving member allowing the rotational bracket to be inserted into or released from the inserting groove while moving in the guide groove;

a movable support having one end rotatably coupled to the moving member and an opposite end coupled to a restoring spring such that the movable support is rotatably fixed; and a damper having buffer power when making contact with one surface of the movable support.

* * * * *